US006134722A

United States Patent [19]

Lowry et al.

[11] Patent Number: 6,134,722

[45] Date of Patent: Oct. 24, 2000

[54] RECIRCULATING BATH FIXTURE

[75] Inventors: Scott R. Lowry, Hamilton, Ohio; Thomas A. Bonnell; Robert C. Giese, both of Sheboygan, Wis.; Todd S. Schaetz, Waldo, Wis.; Peter W. Swart, Oostburg, Wis.

[73] Assignee: Kohler Co., Kohler, Wis.

[21] Appl. No.: 09/459,845

[22] Filed: Dec. 13, 1999

Related U.S. Application Data

[63] Continuation of application No. 08/578,623, May 20, 1996, abandoned, which is a continuation-in-part of application No. PCT/US94/07859, Jul. 13, 1994.

[51] Int. Cl.[7] ..... A61H 33/00

[52] U.S. Cl. ..... 4/541; 4/541.3; 4/601; 4/678

[58] Field of Search ..... 4/541.1, 541.3, 4/541.4, 541.6, 584, 597, 601, 678

[56] References Cited

U.S. PATENT DOCUMENTS

| | | | |
|---|---|---|---|
| D. 8,731 | 10/1875 | Tweeddale . | |
| D. 15,637 | 12/1884 | Moore . | |
| 1,572,275 | 2/1926 | Ewing . | |
| 1,928,799 | 10/1933 | Stevens | 47/39 |
| 2,792,053 | 5/1957 | Kursman | 155/36.5 |
| 3,121,235 | 2/1964 | Gellmann | 4/148 |
| 3,275,283 | 9/1966 | Rauch | 248/205 |
| 3,480,973 | 12/1969 | Stairs | 4/145 |
| 4,099,272 | 7/1978 | Sowder | 4/148 |
| 4,224,700 | 9/1980 | Bloys | 4/603 |
| 4,274,400 | 6/1981 | Baus | 128/53 |
| 4,334,328 | 6/1982 | Delepine | 4/191 |
| 4,346,484 | 8/1982 | Martin | 4/507 |
| 4,513,458 | 4/1985 | Delepine | 4/192 |
| 4,724,553 | 2/1988 | Bianchi | 4/615 |
| 4,796,312 | 1/1989 | Corlew | 4/555 |
| 4,823,409 | 4/1989 | Gaffney | 4/192 |
| 4,881,280 | 11/1989 | Lesikar | 4/507 |
| 4,912,782 | 4/1990 | Robbins | 4/192 |
| 4,926,510 | 5/1990 | Watkins | 4/542 |
| 4,964,399 | 10/1990 | Faimali | 128/66 |
| 4,998,305 | 3/1991 | Davis | 4/604 |

(List continued on next page.)

FOREIGN PATENT DOCUMENTS

| | | | |
|---|---|---|---|
| 0178453 | 4/1986 | European Pat. Off. . | |
| 275084 | 7/1988 | European Pat. Off. . | |
| 88.192 | 12/1966 | France . | |
| 2469212 | 5/1981 | France . | |
| 2671475 | 7/1992 | France . | |
| 1956824 | 6/1970 | Germany . | |
| 2641802 | 3/1978 | Germany . | |
| 5154426 | 6/1993 | Japan | 239/193 |
| WO 8704059 | 7/1987 | WIPO . | |

OTHER PUBLICATIONS

P. 10–3a of a Kohler Co. K–550 catalog dated Aug. 1991 showing the Whitecap Shower/Foot Bath Whirlpool.

P. 88 of a 1991 Bains magazine entitled "Jets toniques et douche–plaisir" with a partial translation.

The cover and next page of a "New Products" 1992 brochure of the Kohler Co. showing the "Mastershower tower".

P. 10 of a 1989 Kohler Co. brochure illustrating the "Tea–for Two" Whirlpool Bath.

P. 2–4 of a Kohler Co. K–500 catalog illustrating the "PILLOWS" flume spout.

A cover page of a 1992 Jacuzzi Owner's Manual.

2 pages of a News Release describing the "J–DREAM Whirlpool Bath".

P. 89 of a 1991 Bains magazine showing three shower units.

*Primary Examiner*—Robert M. Fetsuga

*Attorney, Agent, or Firm*—Quarles & Brady LLP

[57] ABSTRACT

A spout which can effect a waterfall in the form of a sheet of water in conjunction with the recirculation of bathing water is described. An accumulator with a baffle structure receives the recirculating bathing water to place it in a quiescent state before passage from the spout. In a preferred embodiment, there is a whirlpool basin which receives bathing water from the spout as well as body spray nozzles which also receive recirculating water from the basin.

2 Claims, 6 Drawing Sheets

U.S. PATENT DOCUMENTS

| | | | |
|---|---|---|---|
| 5,060,322 | 10/1991 | Delepine | 4/601 |
| 5,068,930 | 12/1991 | Ruggiero | 4/560 |
| 5,073,996 | 12/1991 | Schinle | 4/601 |
| 5,115,974 | 5/1992 | Tobias et al. | 239/23 |
| 5,127,111 | 7/1992 | Sieth | 4/591 |
| 5,167,368 | 12/1992 | Nash | 239/17 |
| 5,197,459 | 3/1993 | Henkin et al. | 128/66 |
| 5,249,744 | 10/1993 | Ruthenberg | 239/23 |
| 5,289,599 | 3/1994 | Hintz et al. | 4/613 |
| 5,293,654 | 3/1994 | Castwell et al. | 4/598 |
| 5,329,650 | 7/1994 | Zaccai et al. | 4/605 |

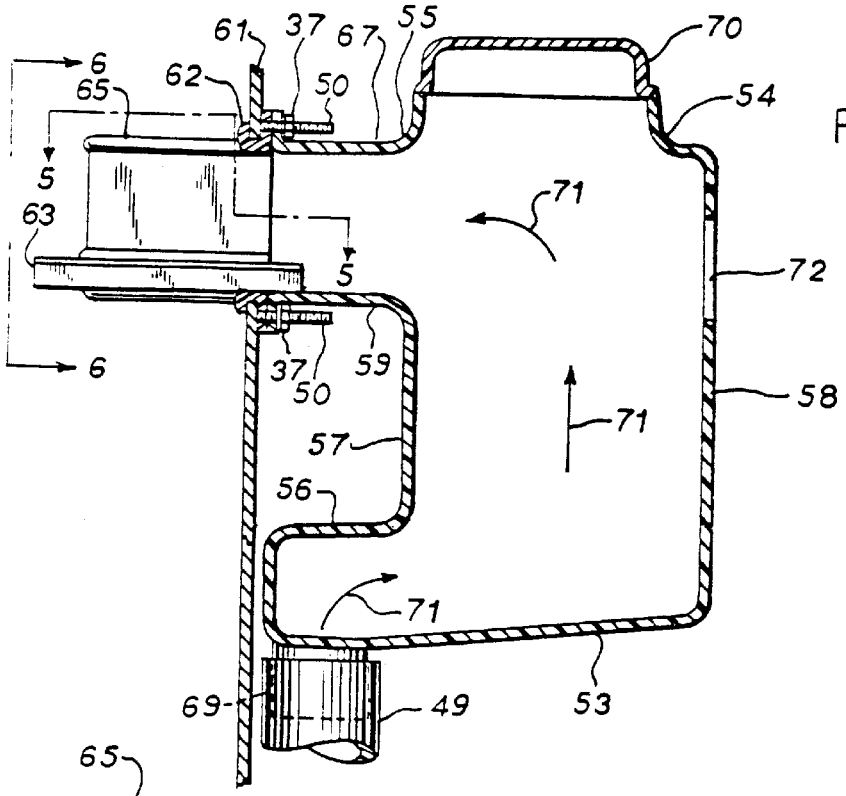
FIG. 4
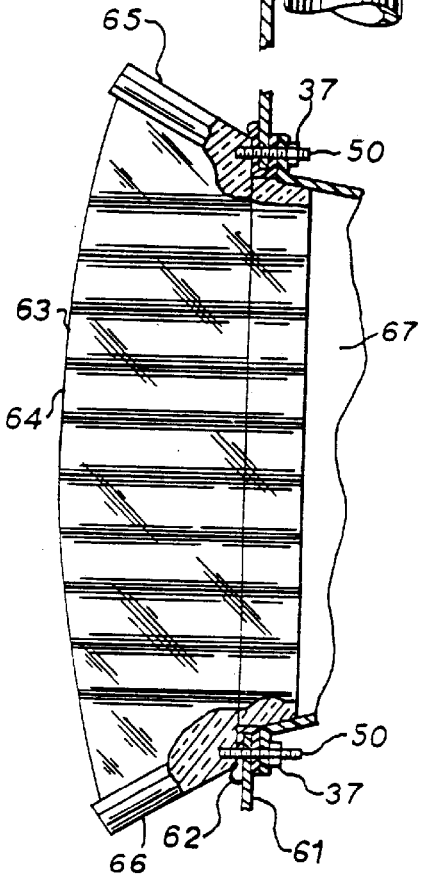
FIG. 5
FIG. 6
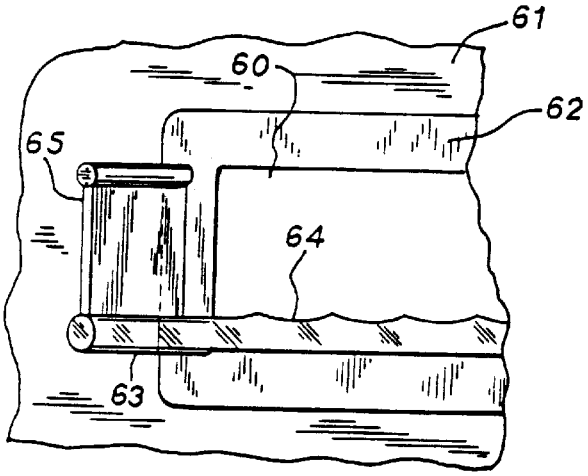

RECIRCULATING BATH FIXTURE

CROSS-REFERENCE TO RELATED APPLICATIONS

This is a continuation of application Ser. No. 08/578,623 filed May 20, 1996, now abandoned which is a CIP International application number PCT/US94/07859 filed Jul. 13, 1994.

STATEMENT REGARDING FEDERALLY SPONSORED RESEARCH OR DEVELOPMENT

Not applicable.

BACKGROUND OF THE INVENTION

1. Technical Field

The field of the invention is bathing fixtures, and more particularly, fixtures which employ recirculation of the bathing water to an elevated spout.

2. Background Art

Showers which combine a foot whirlpool in conjunction with an overhead shower nozzle and a seat are known. Such a unit is available from the Kohler Co. as the Whitecap shower and foot bath whirlpool. There is also known in the prior art a bathing fixture wherein the bathing water is recirculated to an overhead shower. This is described in U.S. Pat. No. 4,724,553 where bathing water is recirculated to rotating nozzle structures.

"Sheet flow" spouts, where water cascades in a waterfall rather than spray fashion, have also been used in bathing areas. Such a bathing fixture is also available from Kohler Co. as the Mastershower tower. However, this system uses line pressure water as its water supply source.

The prior art does not provide a bathing fixture wherein the bathing water is recirculated to a sheet flow spout so as to afford a sheet-like cascading waterfall. A difficult problem is presented in designing such a system is that pumped recirculating water is of unsteady pressure, and this does not readily lend itself to use in a spout that forms a sheet of water (as distinguished from sprays through multiple holes).

DISCLOSURE OF THE INVENTION

In one aspect the invention provides a bathing fixture wherein water is recirculated to a spout which includes a lower basin for collecting water and a waterfall spout having an outlet mounted above the basin. A pump is provided for recirculating water that has collected in the basin to the spout, whereby the spout can deliver a sheet of water through the outlet.

In one preferred form, the pump can be directed to pump water to a whirlpool outlet in a basin side wall. The basin is part of a foot bath. This could be an alternative flow path.

In another preferred form, the bathing fixture includes an accumulator cavity positioned between the pump and outlet of the spout for collecting water delivered from the pump and dampening water pressure differences at the outlet.

In another aspect, there is a waterfall spout for supplying a sheet of water. The spout has an inlet and a outlet in the form of a slot. There is an accumulator between the outlet and inlet having greater cross sectional area than either. The accumulator has a baffle system for causing water to change (preferably completely reverse) direction at least once when traveling from the inlet to the outlet so as to thereby collect water and dampen water pressure differences at the outlet. The outlet has a ledge extending generally horizontally at the spout outlet. In a preferred form, the ledge has an undulating upper surface.

In yet another preferred form, there are a plurality of body spray nozzle members disposed in a vertical manner between the basin and the receptacle member.

In still another aspect, there is an extendable and retractable seat which allows a bather to sit or stand during bathing.

The objects of the invention therefore include:

a. providing a waterfall spout of the above kind which provides a cascading waterfall while using recirculated water;

b. providing a foot bathing fixture of the above kind wherein bathing water is recirculated to either a foot bathing fixture, a body spray nozzle, or a waterfall spout, individually; and c. providing a foot bathing fixture of the above kind wherein recirculated water is brought to a relatively steady state prior to its flowing from the waterfall spout.

The foregoing and other objects and advantages of the invention will appear from the following description. In the description, reference is made to the accompanying drawings which form a part hereof, and in which there is shown by way of illustration preferred embodiments of the invention. Such embodiments do not necessarily represent the full scope of the invention. Therefore, reference is made to the claims herein for interpreting the scope of the invention.

BRIEF DESCRIPTION OF THE INVENTION

FIG. 4 is an enlarged view, in vertical section, showing the waterfall spout feature of the invention;

FIG. 5 is a sectional view taken along line 5—5 of FIG. 4;

FIG. 6 is a partial elevational view taken along line 6—6 of FIG. 4;

BEST MODE FOR CARRYING OUT THE INVENTION

Figure 1:
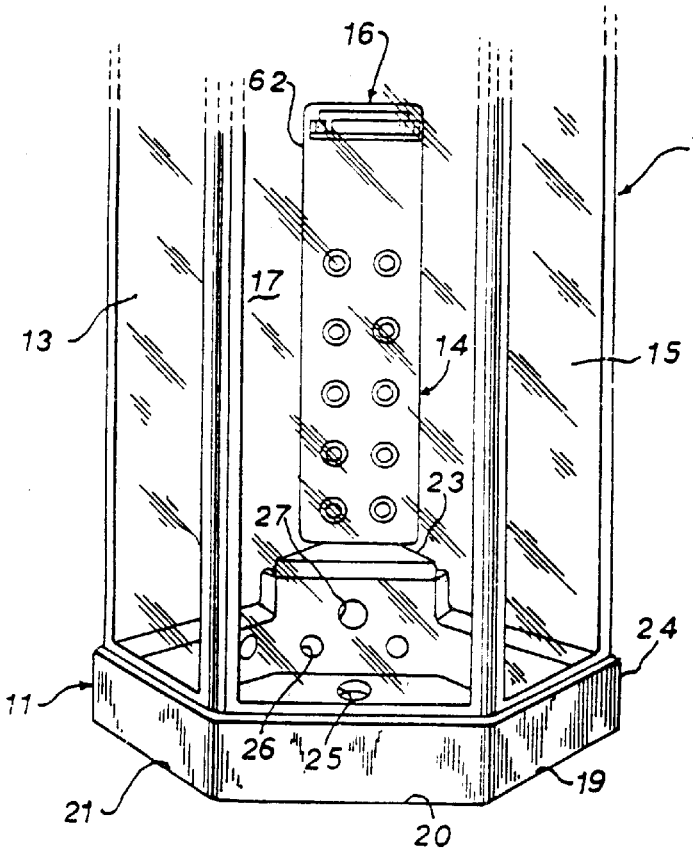
FIG. 1 is a front perspective view showing the bathing fixture constituting a preferred embodiment of the invention.
Figure 7:
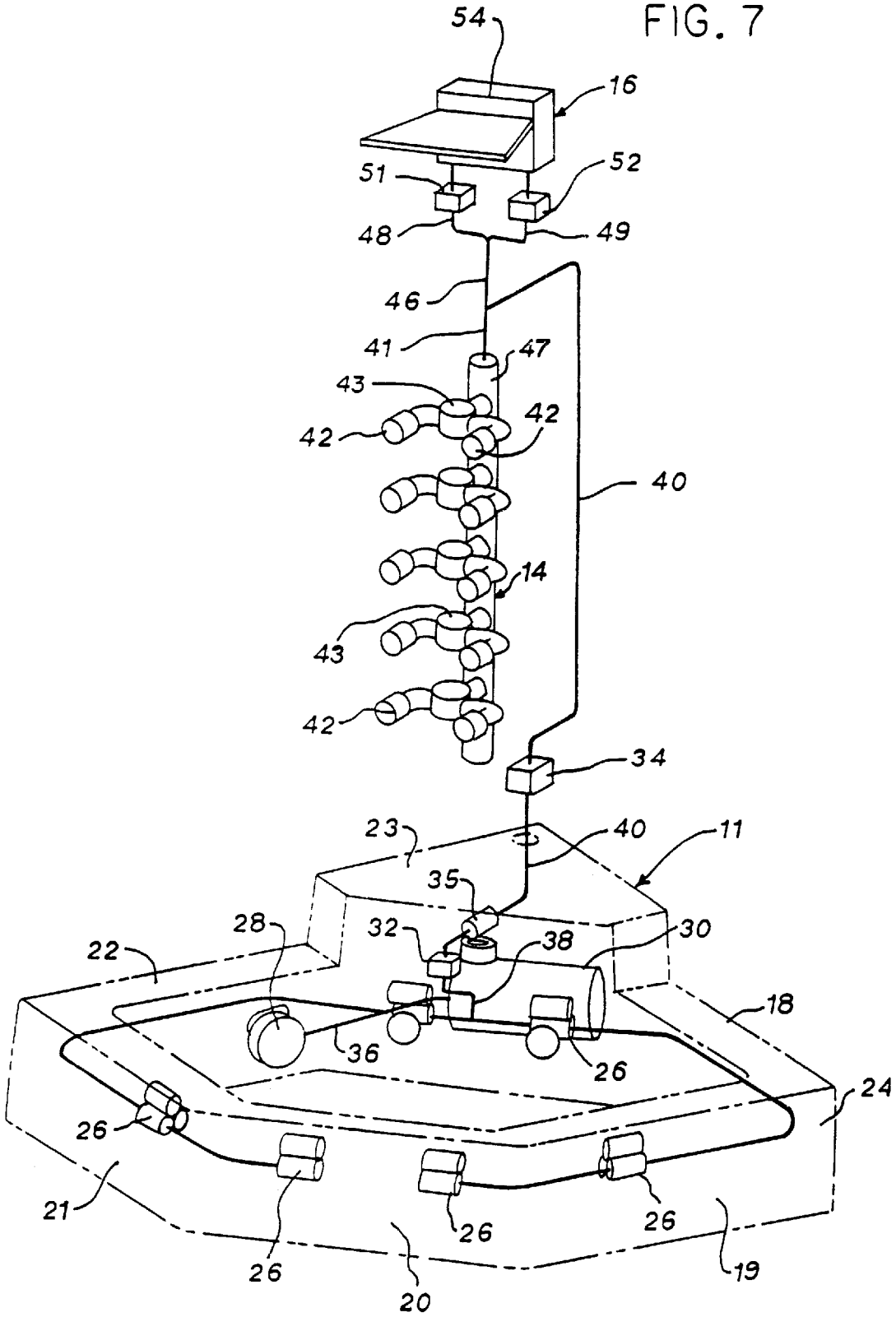
FIG. 7 is a diagrammatic view showing the water recirculation pathways.

Referring particularly to FIGS. 1 and 7, the bathing fixture (generally 10) includes a basin 11, a jet nozzle assembly 14 and a waterfall spout 16. The basin 11 is essentially disclosed in U.S. patent application Ser. No. 07/640,175 filed Jan. 11, 1991 now U.S. Pat. No. 5,289,599 and is commonly assigned. Its teachings are herein incorporated by reference.

The basin is of the foot bath whirlpool type, and includes side walls 18, 19, 20, 21 and 22. There is also provided a seat 23 and drain 25 which under normal operating conditions is closed. An enclosure is effected by the side panels 13 and 15 and a door panel 17 (and the bathroom side walls). There are whirlpool jet outlets 26 in the basin as well as an overflow drain 27. As best seen in FIG. 7, an inlet 28 to the recirculation system is connected by the line 36 to the pump 30, which feeds bathing water to the jets 26 by means of the "T" connector 35, valve 32 and outlet line 38. A variable flow valve 34 controls the flow of water to the waterfall spout 16, as well as the body spray nozzle assembly 14 by means of line 40. Water will be initially introduced to the basin 11 such as by a standard bath spout (not shown).

Figure 2:
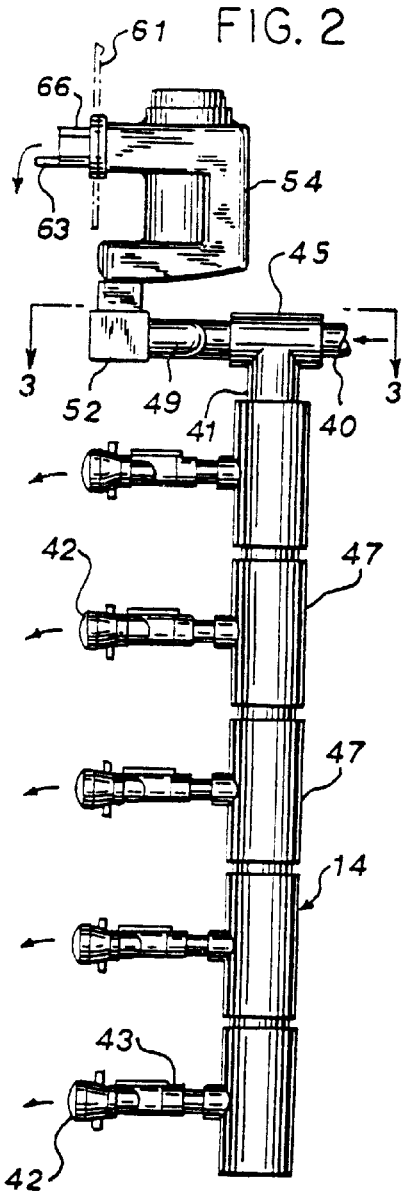
FIG. 2 is an enlarged partial side view showing the body spray nozzles and waterfall spout feature.

A jet nozzle assembly 14 receives water from line 41 which is connected to a series of valve bodies 47. This is seen in FIG. 2. It includes five sets of nozzles 42 each individually controlled by a valve 43 so that water can be sprayed from the nozzles 42 at different heights if desired. The preferred nozzles 42 are those disclosed in U.S. patent application Ser. No. 08/238,998 filed May 6, 1994 and is commonly assigned. Its teachings are herein incorporated by reference.

In a preferred manner, the seat 23 is slidable in and out so that the bather can experience the effects of the waterfall spout 16, the jet nozzle assembly 14 or the whirlpool jet outlets 26 when seated with the seat extended. The seat would be retracted so the bather can effect the same purpose while standing.

Figure 3:
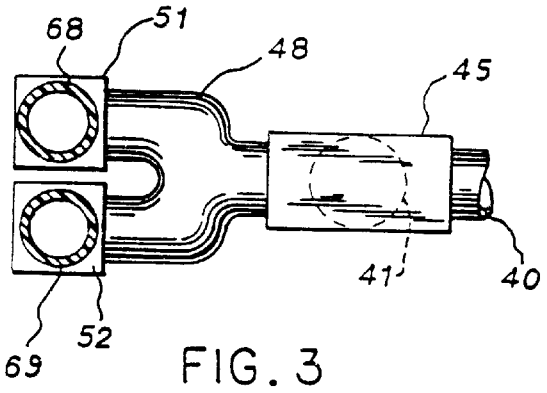
FIG. 3 is a view taken along line 3—3 of FIG. 2.

With reference to the spout 16, line 46 conveys water to branch lines 48 and 49 through valves 51 and 52 and to the water accumulator 54 of spout 16. As shown in FIGS. 2 and 3, water from line 40 is fed through a "T" connection 45 to the two branch lines 48 and 49 to introduce water through one of the inlets 68 and 69 into the accumulator 54.

Referring to FIG. 4, accumulator 54 has a horizontal baffle wall 56 opposite the inlet 69 in order to redirect the flow of bathing water in the accumulator 54 at a right angle so that it cannot flow directly to the outlet passage 67. Accordingly, water changes direction and flows in the direction of the flow arrows 71 and between the vertical walls 57 and 58. It flows outwardly over horizontal wall 59 and under horizontal wall 55 forming the outlet passage 67. An opening 60 is provided in outlet passage 67, and water flows freely over a ledge member 63 extending from opening 60.

Ledge member 63 is partially supported by the outlet passage 67 as well as by the opposing diverging guide members 65 and 66. This is seen in FIGS. 5 and 6. These guide members not only support the ledge 63 but provide a barrier for the water from flowing laterally off of the ledge 63. Guide members 65 and 66 are secured to the ledge member 63 and the accumulator 54 such as by adhesively adhering the guide members 65 and 66 to the sides of the ledge member 63 and connecting the guide members 65 and 66 to the accumulator 54 such as by studs 50 and nuts 37 passing through frame 62. Frame 62 is also connected to the accumulator by the studs 50 and nuts 37.

As seen in FIGS. 5 and 6, the ledge member 63 has an undulating surface 64 for the purpose of effecting a smooth and uniform water flow at low flow rates. The undulations direct the water in a generally parallel manner along the axis of water flow at the low flow rates to provide a sheet flow. This is an important feature in permitting the accumulator system to be used at normal pump speeds.

As seen in FIGS. 4 and 5, a panel member 61 is connected to the accumulator such as by the framework 62. There is an opening 72 in the back wall 58 so that a light can be provided to illuminate the water therein for an aesthetic effect. A removable top 70 provides access to the inside of the accumulator so as to affix and service a light provided therein.

An important feature of the recirculating whirlpool and the waterfall spout is the fact that it can recirculate bathing water and yet afford a well formed waterfall "sheet" at the top of the unit. This is accomplished in part by means of the accumulator 54 and the wall structure so that indirect water flow is effected from a pump. This indirect flow path, plus the fact that the accumulator has a substantially larger volume or greater cross sectional area than either the outlet passage 67 or inlets 68 and 69 gives a quiescent state to the water. This quiescent state in conjunction with the ledge member 63, provides in effect a gravitational or cascading waterfall similar to the flow of water over a dam. Importantly, the water sheet stays together for a significant distance after leaving the spout edge.

It will be appreciated that not only can the water be recirculated to the waterfall spout 16, but also to the body spray nozzle assembly 14 as well as the whirlpool jet outlets 26 in the basin 24. These are alternative flow paths. As indicated previously, the flow of water can be controlled separately to the jet outlets 26 such as by the valve 32 and to the jet nozzle assembly 14 and the waterfall spout 16 by the variable flow valve 34. In addition, individual body spray nozzles are controlled by the valves 43 and the flow of water to the waterfall additionally controlled by the valves 51 and 52.

The pump 30 and conduit lines such as 40 and 41 are designed so as to be able to supply recirculated water to nozzles 42 at a flow rate of at least 50 gallons per minute and in some instances can be as high as 95 gallons per minute. This is accomplished by utilizing conduit lines having few bends, a 1½ inch diameter and butterfly type valves for those shown at 43.

Figure 8:
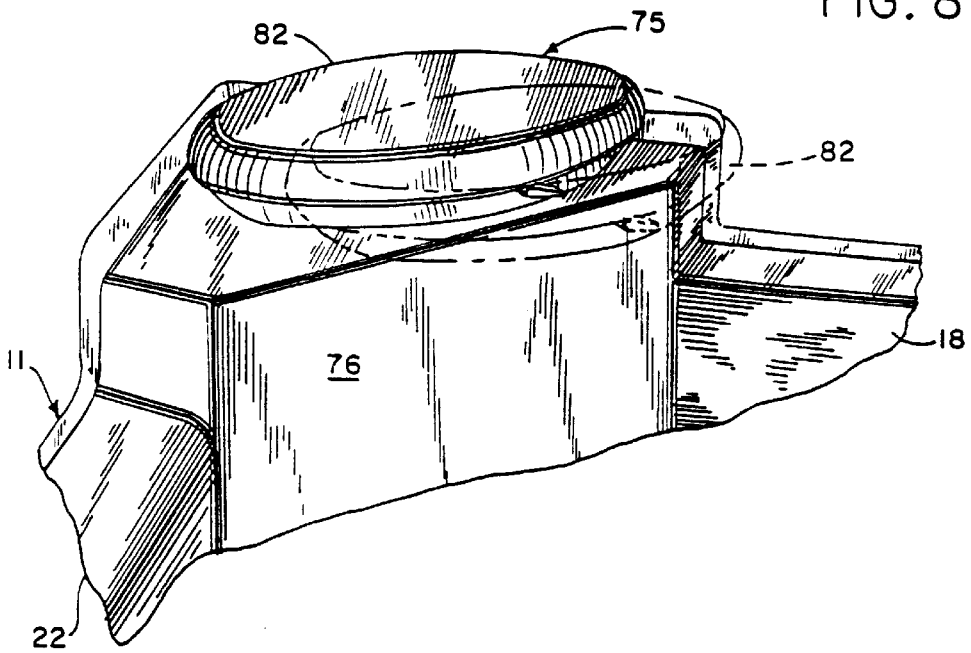
FIG. 8 is a front perspective view of an extendable and retractable seat assembly for use with the bathing fixture.

FIGS. 8–13 illustrate a slidable or retractable seat assembly generally 75 which can be employed in place of seat 23 and is connected to a pedestal portion 76 of the basin 11. As seen in FIG. 8, seat assembly 75 is illustrated in solid lines in the extended position which a bather would use if it is desired to be seated during bathing in conjunction with nozzles 42 or the waterfall spout 16. The retracted position is shown in broken lines and is the position which would be that employed when the bather would stand during bathing.

Figure 13:
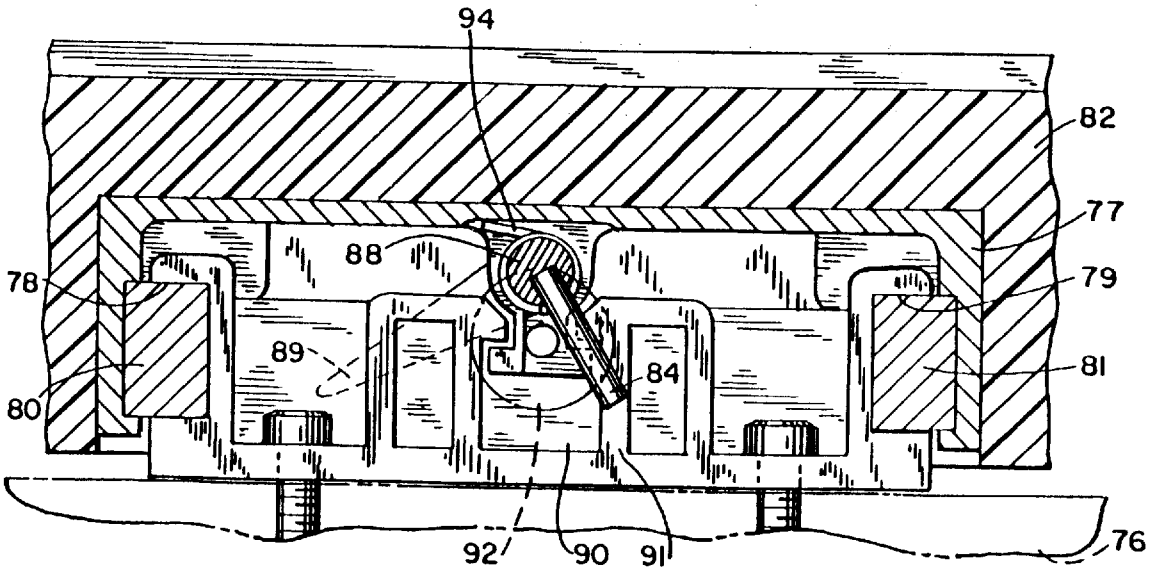
FIG. 13 is a sectional view taken along line 13—13 of FIG. 11.

As shown in FIGS. 9–12, seat assembly 75 includes a base portion 77 for connection to the pedestal 76 such by the screws 73. Base portion 77 has opposing guide slots 78 and 79 for slidably receiving guide rails 80 and 81 extending from floor 74 of substantially flat cover or seat portion 82. A two position stop mechanism generally 83 is centrally connected on the underside of the seat portion 82 and includes two projecting pin members 84 and 85 with pin member 85 extending from slot 86 of housing 87. A rotatable rod 88 is positioned inside housing 87 and connected to the pin members 84 and 85 for pivoting the members by the lever 89 in conjunction with a torsion spring 94. This is best seen in FIG. 13.

Figure 9:
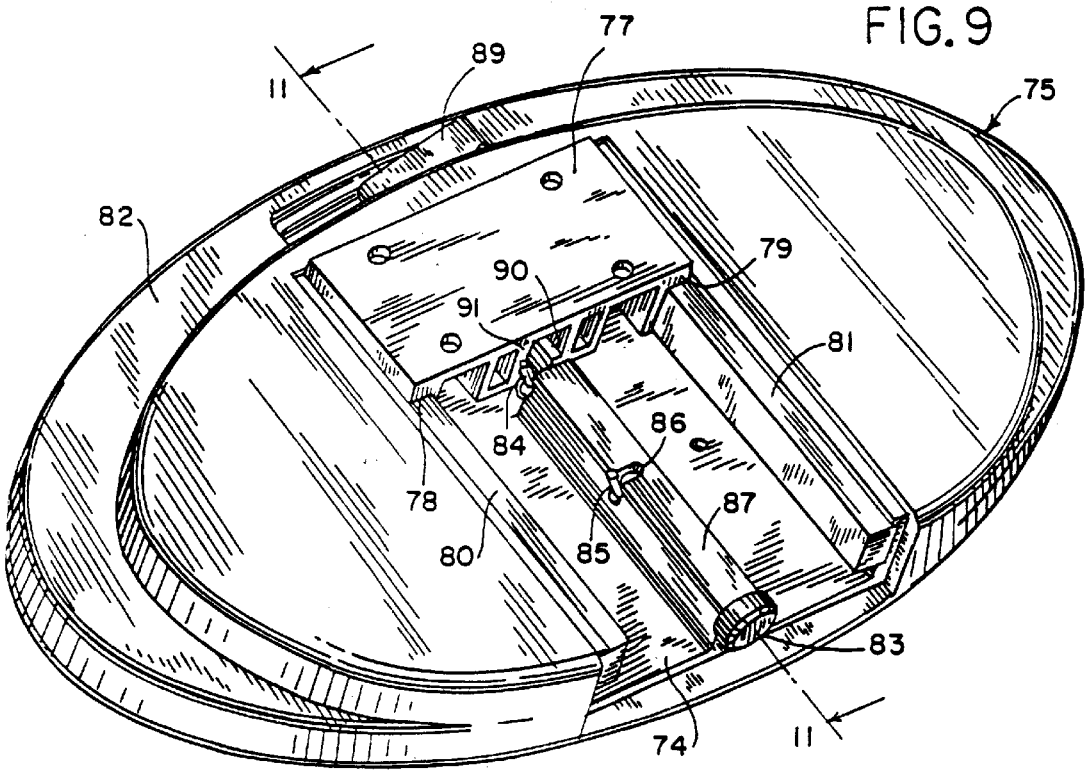
FIG. 9 is a bottom perspective view of the seat assembly shown in FIG. 8.
Figure 10:
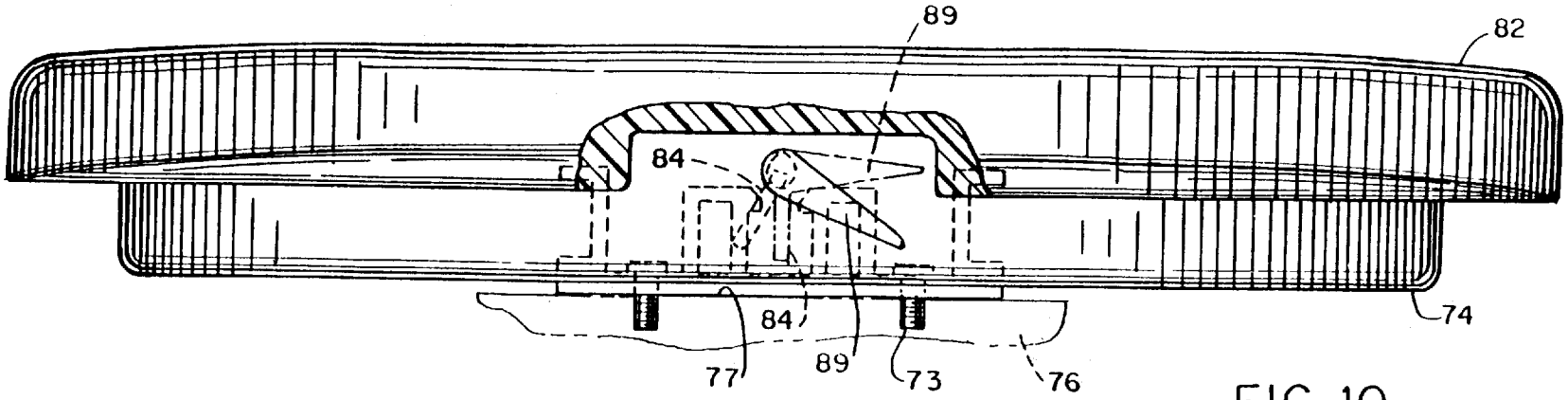
FIG. 10 is a front elevational view with a portion broken away illustrating a locking and unlocking feature.
Figure 11:
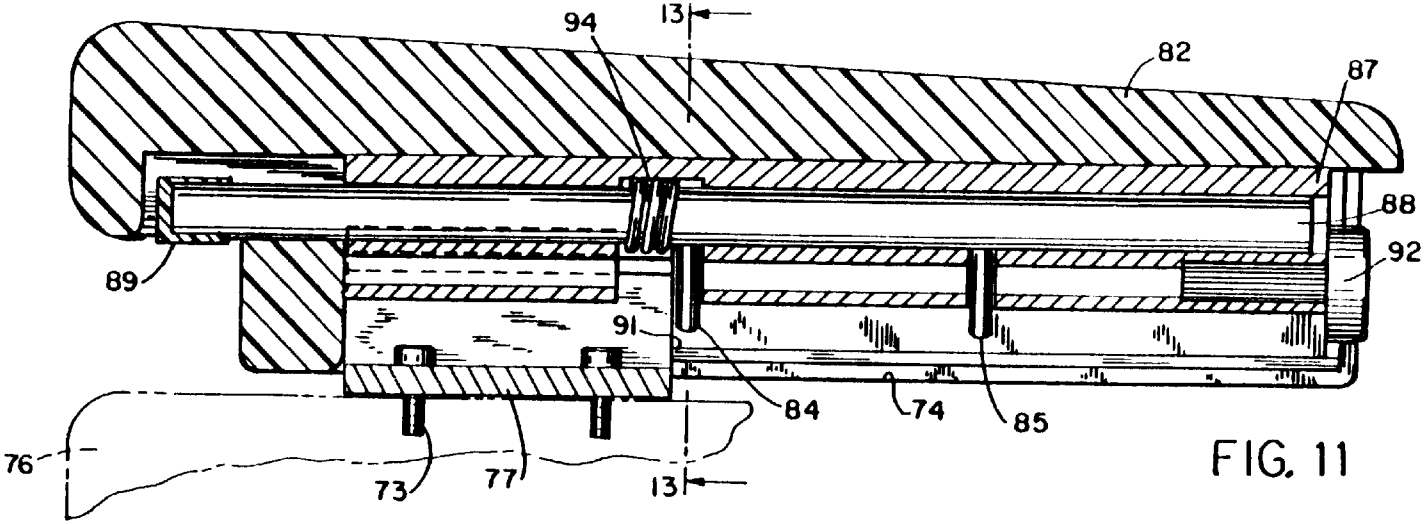
FIG. 11 is a sectional view showing the seat assembly in a retracted position.
Figure 12:
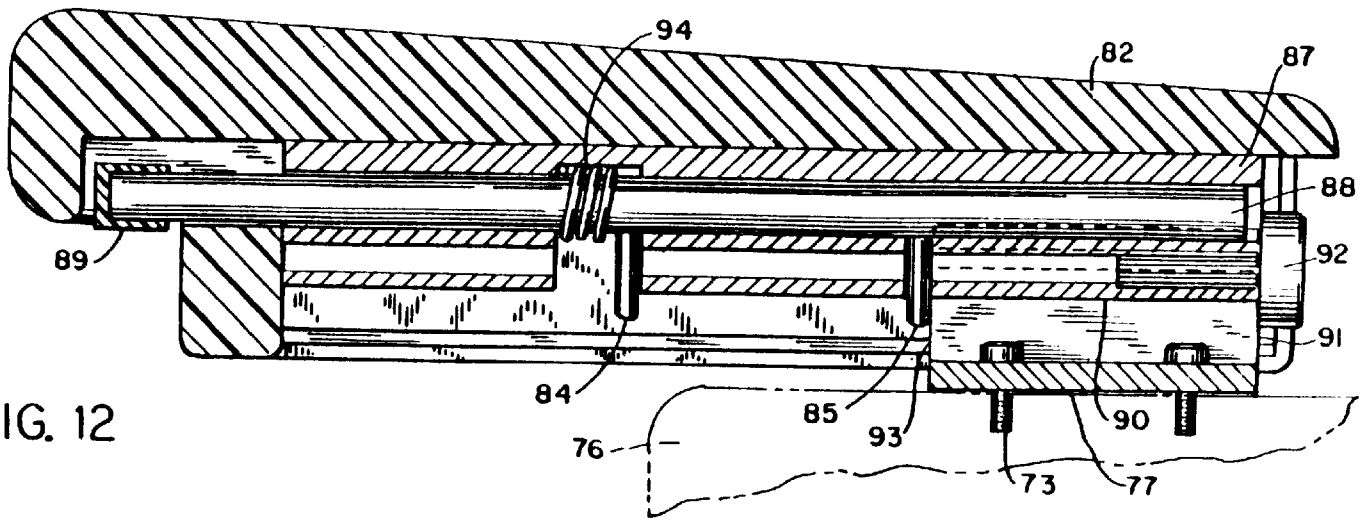
FIG. 12 is a view similar to FIG. 11 showing the seat assembly in an extended position.

Housing 87 is aligned with central channel 90 of the base portion 77. This permits the housing 87 to pass therethrough, as well as pin members 84 and 85 when they are moved out of contact with base portion 77. This is best seen in FIG. 10. As shown in FIGS. 9 and 11, the seat portion 82 is in the retracted position. To move the seat portion 82 to the extended position, lever 89 is rotated to move the pin member 84 out of contact with stop surface 91 of base portion 77 and the seat portion 82 is moved forward with the housing 87 passing through the channel 90, as well as pin members 84 and 85. Forward movement of the seat portion 82 will stop when stop member 92 connected to housing 87 contacts stop surface 91. This is the extended position shown in FIG. 12. Stop member 92 is spaced from pin member 85 approximately the same length as channel 90 so pin member 85 will now contact the front side 92 of the base support 77. To retract the seat portion 82, the previous procedure is reversed with the pin members aligned to pass through channel 90 to reposition the seat portion 82 as shown in FIG. 11.

Thus the invention provides an improved bathing fixture. While the waterfall feature and spout 16 has been shown in conjunction with a whirlpool bathing fixture and the jet nozzle assembly 14, it should be appreciated that the waterfall effect, is under normal conditions, utilized separately and without them. However, as indicated above, they could operate together in any combination. Accordingly, under normal operating conditions it is desirable to have the variable controls such as valves 32 and 34 as this provides for a more versatile operation. While two valves 51 and 52 have been shown in conjunction with controlling the water flow to the accumulator 54, only one valve is required in conjunction with a single line rather than the two lines 48 and 49 as shown.

In some instances, for economic reasons, the waterfall spout 16 can be eliminated, as well as the upper pair of nozzles 42. Recirculated water would be supplied to the lower four pairs of nozzles at a rate to effect a waterfall condition.

INDUSTRIAL APPLICABILITY

The invention has utility for inter alia residential bathing facilities.

What is claimed is:

1. A bathing fixture wherein water is recirculated through a multiplicity of shower spray spouts, comprising:

a basin for collecting water;

a conduit extending from the basin;

a multiplicity of shower spray spouts positioned above the basin;

a waterfall spout in fluid communication with the basin; and a pump forming a part of the conduit;

whereby the fixture is configured to permit recirculation of water from the basin to the shower spray spouts at a rate of at least 50 gallons per minute and to the waterfall spout.

2. The bathing fixture as defined in claim 1, wherein the spouts are body spray nozzles at least two of which are at different vertical heights.

* * * * *

UNITED STATES PATENT AND TRADEMARK OFFICE

CERTIFICATE OF CORRECTION

PATENT NO. : 6,134,722
DATED : October 24, 2000
INVENTOR(S) : Thomas A. Bonnell and Robert C. Giese It is certified that error appears in the above-identified patent and that said Letters Patent is hereby corrected as shown below:

Title page,
In the heading, change [Lowry et al.] to Bonnell et al..
In the identification of the inventors, replace the current list of inventors with Thomas A. Bonnell and Robert C. Giese, both of Sheboygan, Wisconsin.

Related U.S. Data section, change [a continuation-in-part of application] to a CIP international application.

Signed and Sealed this

Fifth Day of March, 2002

*Attest:*

*Attesting Officer*

JAMES E. ROGAN
*Director of the United States Patent and Trademark Office*